US005735781A

United States Patent [19]

Pai

[11] Patent Number: 5,735,781

[45] Date of Patent: Apr. 7, 1998

[54] EXERCISING LOOP

[76] Inventor: Hsueh-Chin Pai, P. O. Box 82-144, Taipei, Taiwan

[21] Appl. No.: 760,983

[22] Filed: Dec. 5, 1996

[51] Int. Cl.[6] ..... A63B 21/02

[52] U.S. Cl. ..... 482/126; 482/44; 482/122

[58] Field of Search ..... 482/44, 121, 122, 482/126

[56] References Cited

U.S. PATENT DOCUMENTS

| | | | |
|---|---|---|---|
| 3,938,803 | 2/1976 | Wilmoth et al. | 482/44 |
| 4,775,149 | 10/1988 | Wilson | 482/126 |
| 5,342,273 | 8/1994 | Plendl et al. | 482/126 |

*Primary Examiner*—Lynne A. Reichard
*Attorney, Agent, or Firm*—A & J

[57] ABSTRACT

An exercising loop including a steel open loop having two opposite ends facing each other and spaced by a gap, a coil spring mounted on the steel open loop, a collapsible cloth sleeve sleeved onto the coil spring around the steel open loop, a connecting tube covered with a sponge covering and fixedly connected between the two opposite ends of the steel open loop, and two grips respectively mounted around the two opposite ends of the steel open loop and fixedly connected to the two opposite ends of the cloth sleeve and separated by the connecting tube, the grips being moved with the hands along the steel open loop in reversed directions to compress the coil spring when exercising.

4 Claims, 4 Drawing Sheets

EXERCISING LOOP

BACKGROUND OF THE INVENTION

1. Field of the Invention

This invention relates to exercising apparatus, and more particularly to an exercising loop adapted for exercising different parts of the body including the arms and the abdomen.

2. Description of the Prior Art

A variety of exercising apparatus, such as rowing machines, stationary bicycles, exer-hikers, abdominal fitness apparatus, etc., have been disclosed, and have appeared on the market. These exercising apparatus are commonly heavy and expensive. Furthermore, these exercising apparatus are not handy and movable.

SUMMARY OF THE INVENTION

This invention relates to exercising apparatus, and more particularly to an exercising loop adapted for exercising different parts of the body including the arms and the abdomen.

It is one object of the present invention to provide an exercising loop which is practical for exercising different parts of the body including the arms and the abdomen. It is another object of the present invention to provide an exercising loop for exercising the arms and the abdomen which is inexpensive to manufacture. It is still another object of the present invention to provide an exercising loop for exercising the arms and the abdomen which is handy. According to one aspect of the present invention, the exercising loop comprises a steel open loop having two opposite ends facing each other and spaced by a gap, a coil spring mounted on the steel open loop, a collapsible cloth sleeve sleeved onto the coil spring around the steel open loop, a connecting tube covered with a sponge covering and fixedly connected between the two opposite ends of the steel open loop, and two grips respectively mounted around the two opposite ends of the steel open loop and fixedly connected to the two opposite ends of the cloth sleeve and separated by the connecting tube. When in use, the grips are moved with the hands along the steel open loop in reversed directions to compress and release the coil spring. According to another aspect of the present invention, a rubber cushion is fixedly mounted on the cloth sleeve opposite to the connecting tube, so that the rubber cushion can be stopped at the abdomen, and then pulls the grips with the hands toward the body to compress the coil spring.

DETAILED DESCRIPTION OF THE PREFERRED EMBODIMENT

Figure 1:
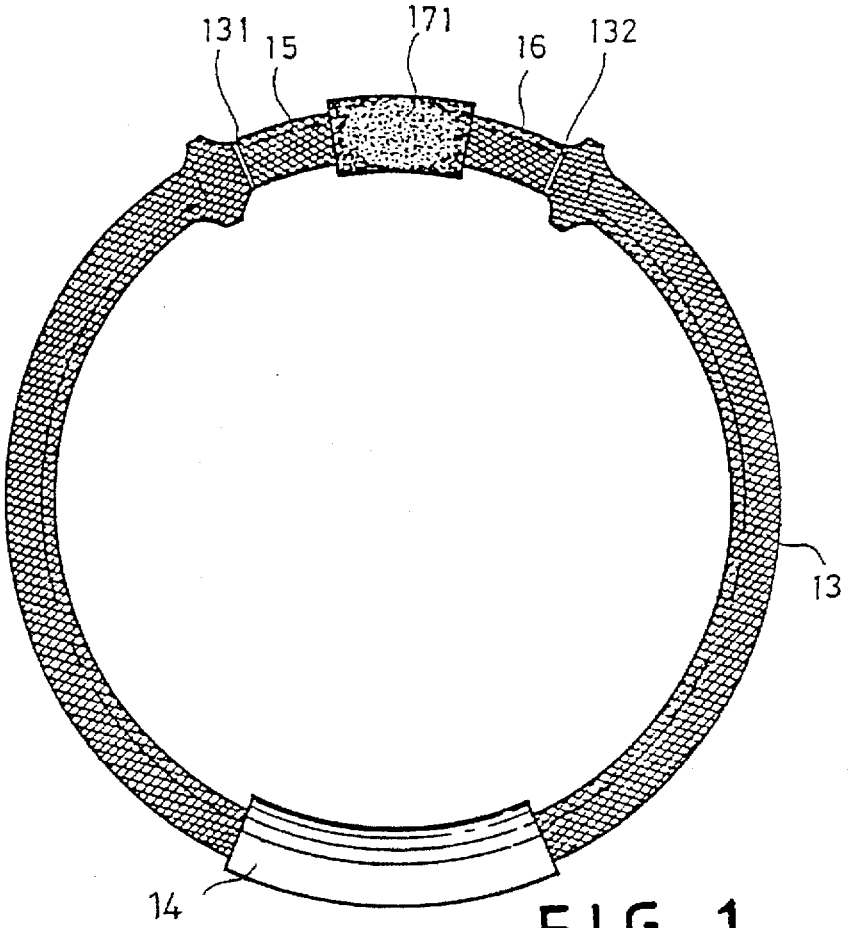
FIG. 1 is an elevational view of an exercising loop according to the present invention.
Figure 2:
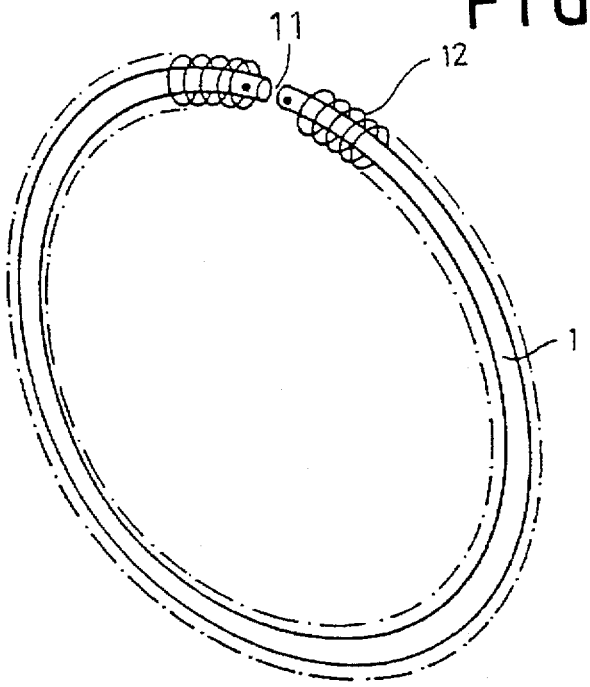
FIG. 2 is a partial view of the present invention, showing the coil spring mounted on the steel open loop.
Figure 3:
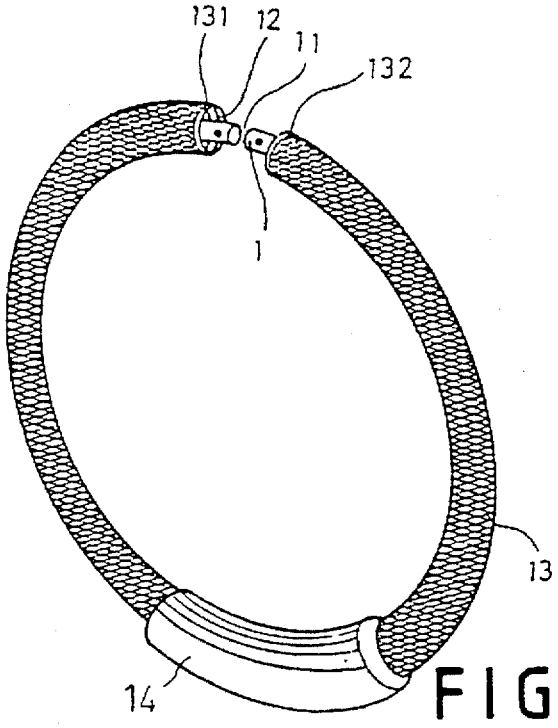
FIG. 3 is another partial view of the present invention, showing the collapsible cloth sleeve and the rubber cushion installed.
Figure 4:
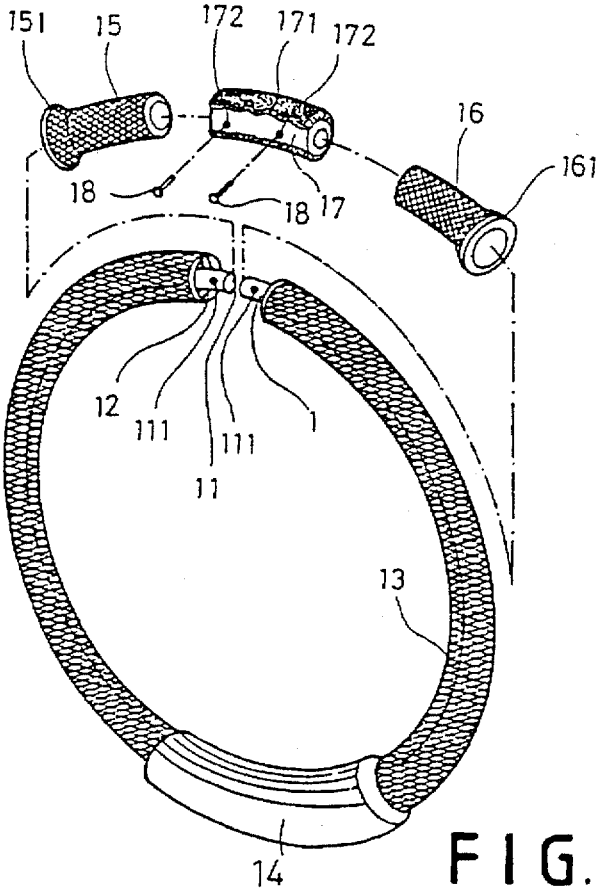
FIG. 4 is an exploded view of the preferred embodiment of the present invention.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Referring to FIGS. 1, 2, 3, and 4, an exercising loop in accidence with the present invention comprises a steel open loop 1 having an opening 11, a coil spring 12 mounted on the steel open loop 1, a collapsible cloth sleeve 13 sleeved onto the coil spring 12 and the steel open loop 1 and having two elastic bands 131, 132 at two opposite ends, a rubber cushion 14 mounted around the cloth sleeve 13 opposite to the opening 11 of the steel open loop 1, two grips 15, 16 respectively mounted around the two opposite ends of the steel open loop 1 and having a respective expanded outer end 151, 161 respectively fastened to the elastic bands 131, 132 of the cloth sleeve 13 and stopped against the two opposite ends of the coil spring 12, and a connecting tube 17 connected between the two opposite ends of the steel open loop 1 to separate the grips 15, 16. The connecting tube 17 is covered with a sponge covering 171, having two transverse mounting holes 172 respectively connected to respective screw holes 111 at the two opposite ends of the steel open loop 1 by screws 18.

Figure 5:
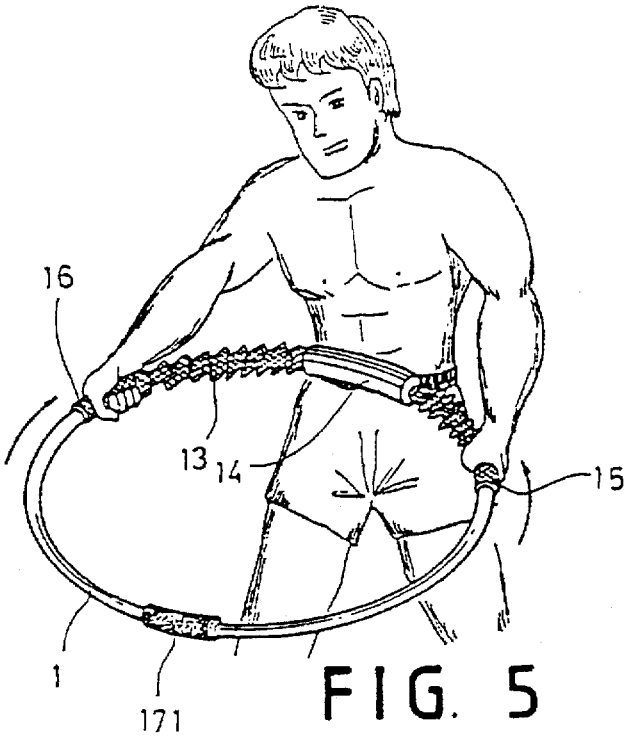
FIG. 5 is a sectional view of the exercising loop shown in FIG. 1.

Referring to FIG. 5, the grips 15, 16 have a respective shoulder 152, 162 disposed within the respective expanded outer end 151, 161, and respectively sopped against the two opposite ends of the coil spring 12. The coil spring 12 imparts a pressure to the grips 15, 16 toward the two opposite ends of the connecting tube 17, thereby causing the grips 15, 16 to be firmly stopped between the two opposite ends of the connecting tube 17 and the two opposite ends of the coil spring 12.

Figure 6:
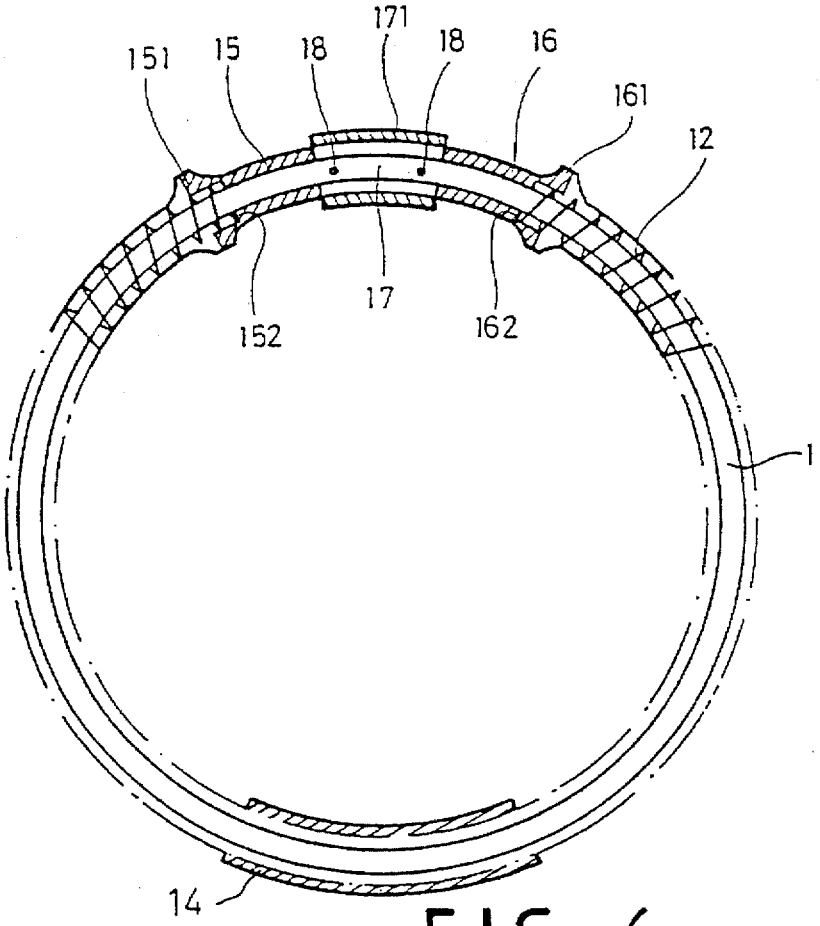
FIG. 6 shows an exercising example of the present invention.

Referring to FIG. 6, when in use, the rubber cushion 14 is stopped at the abdomen, and the grips 15, 16 are pulled with the hands toward the rubber cushion 14 to compress the coil spring 12 (see also FIG. 5). By continuously and alternatively releasing and pulling the grips 15, 16, the muscles of the arms and the abdomen are exercised.

Figure 7:
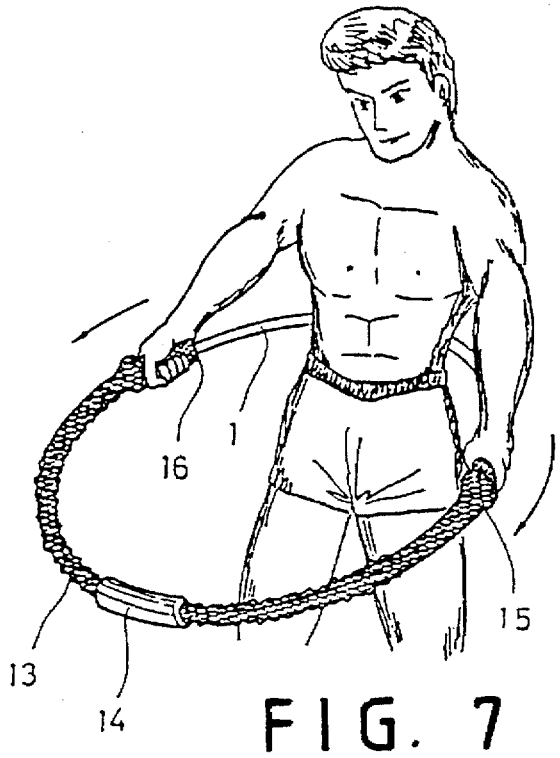
FIG. 7 shows another exercising example of the present invention.

FIG. 7 shows another exercising example of the present invention. As illustrated, the exercising loop can be mounted around the waist with the connecting tube 17 closely attached to the back of the waist, and then the grips 15, 16 are pushed toward the rubber cushion 14 to compress the coil spring 12 (see also FIG. 5).

Figure 8:
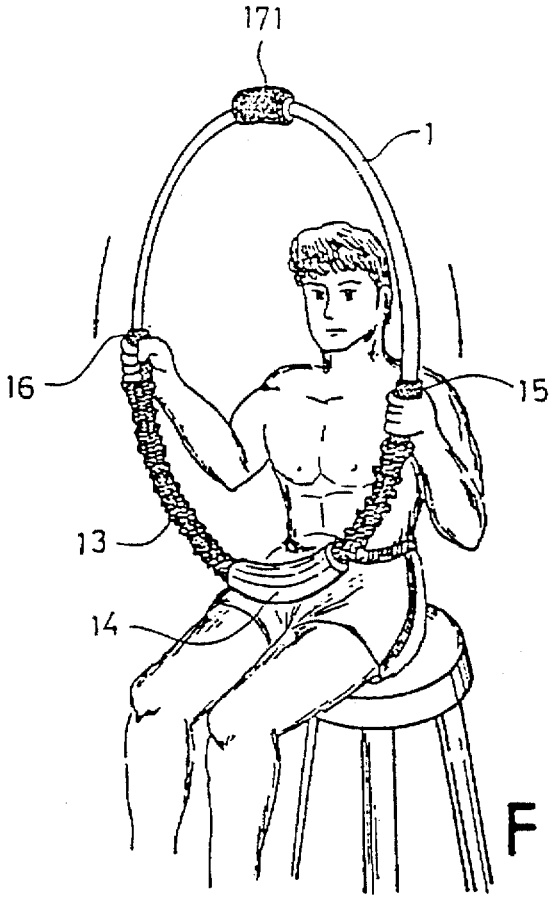
FIG. 8 shows still another exercising example of the present invention.

FIG. 8 shows still another exercising example of the present invention, in which the user sits on a chair with the rubber cushion 14 supported on the user's thighs, and then the grips 15, 16 are pulled up and down with the hands along the steel open loop 1.

The invention is naturally not limited in any sense to the particular features specified in the forgoing or to the details of the particular embodiment which has been chosen in order to illustrate the invention. Consideration can be given to all kinds of variants of the particular embodiment which has been described by way of example and of its constituent elements without thereby departing from the scope of the invention. This invention accordingly includes all the means constituting technical equivalents of the means described as well as their combinations.

I claim:

1. An exercising loop comprising:

a steel open loop having two opposite ends facing each other and spaced by a gap;

a coil spring mounted around said steel open loop;

a collapsible cloth sleeve sleeved onto said coil spring around said steel open loop and having two opposite ends and two elastic bands respectively mounted around the two opposite ends;

a connecting tube covered with a sponge cover and fixedly connected between the two opposite ends of said steel open loop; and, two grips respectively mounted around the two opposite ends of said steel open loop and fixedly connected to the two opposite ends of said collapsible cloth sleeve and separated by said connecting tube, said grips being moved with the hands along said steel open loop in reversed directions to compress said coil spring when exercising.

2. The exercising loop as claimed in claim 1, wherein said grips have a respective expanded outer end respectively connected to the elastic bands at the two opposite ends of said collapsible cloth sleeve.

3. The exercising loop as claimed in claim 1, wherein said grips have a respective shoulder on the inside respectively stopped at the two opposite ends of said coil spring.

4. The exercising loop as claimed in claim 1, further comprising a soft cushion fixedly mounted around said collapsible cloth sleeve opposite to said connecting tube.

* * * * *